US005798481A

United States Patent [19]

Manning et al.

[11] Patent Number: 5,798,481

[45] Date of Patent: Aug. 25, 1998

[54] HIGH ENERGY TNAZ, NITROCELLULOSE GUN PROPELLANT

[75] Inventors: Thelma Manning, Montville; Bernard Strauss, Rockaway; Joseph P. Prezelski, Budd Lake; Sam Moy, Parsippany, all of N.J.

[73] Assignee: The United States of America as represented by the Secretary of the Army, Washington, D.C.

[21] Appl. No.: 743,782

[22] Filed: Nov. 7, 1996

Related U.S. Application Data

[60] Provisional application No. 60/006,671 Nov. 13, 1995.

[51] Int. Cl.[6] ..... C06B 45/10

[52] U.S. Cl. ..... 149/19.8; 149/19.6; 149/92; 149/98

[58] Field of Search ..... 149/19.4, 19.6, 149/19.8, 92, 98

[56] References Cited

U.S. PATENT DOCUMENTS

| | | | |
|---|---|---|---|
| 3,894,894 | 7/1975 | Elrick | 149/19.4 |
| 3,956,890 | 5/1976 | Davis | 149/19.4 |
| 4,919,737 | 4/1990 | Biddle et al. | 149/19.6 |
| 5,074,938 | 12/1991 | Chi | 149/19.4 |
| 5,210,153 | 5/1993 | Manser et al. | 149/19.6 |
| 5,325,782 | 7/1994 | Strauss et al. | 149/19.4 |
| 5,467,714 | 11/1995 | Lund et al. | 149/14 |
| 5,468,313 | 11/1995 | Wallace et al. | 149/97 |
| 5,529,649 | 6/1996 | Lund et al. | 149/19.4 |
| 5,540,794 | 7/1996 | Willer et al. | 149/19.8 |
| 5,565,150 | 10/1996 | Dillehay et al. | 264/3.3 |
| 5,587,553 | 12/1996 | Braithwaite et al. | 149/19.6 |
| 5,591,936 | 1/1997 | Willer et al. | 149/19.4 |

*Primary Examiner*—Edward A. Miller

*Attorney, Agent, or Firm*—John F. Moran; John Callaghan

[57] ABSTRACT

A high energy propellant, comprising at least one oxidizer; a nitrocellulose binder; an ethyl centralite stabilizer; a plasticizer; and an oxetane thermoplastic elastomer energetic binder. The oxetane thermoplastic elastomer energetic binder comprises from about zero percent to about fifteen percent by weight of the propellant. The preferred oxidizer is selected from the group consisting of CL-20, TNAZ, RDX, HMX and mixtures thereof. The oxidizer comprises from about five percent to about forth percent by weight of the propellant. The nitrocellulose binder comprises from about fifteen percent to about fifty percent by weight of the propellant and the ethyl centralite stabilizer comprises from about 0.7 percent to about 1.5 percent by weight of the propellant. The plasticizer is selected from the group consisting of TNAZ, BTTN, TMETN, TEGDN, BDNPA/F, methyl NENA, ethyl NENA and mixtures thereof. The plasticizer comprises from about five percent to about thirty-five percent by weight of the propellant.

3 Claims, No Drawings

HIGH ENERGY TNAZ, NITROCELLULOSE GUN PROPELLANT

The invention described herein may be manufactured, used, and licensed by or for the U.S. Government for U.S. Governmental purposes.

This application claims the benefit of U.S. Provisional application Ser. No. 60/006,671 filed Nov. 13, 1995.

FIELD OF THE INVENTION

The present invention relates generally to a high energy propellant composition. More particularly the invention relates to a propellant that includes an energetic thermoplastic elastomer as a binder in a tank gun propellant system.

BACKGROUND OF THE INVENTION

New weapon systems require higher munitions performance. Current standard propellants do not have adequate energy to deliver the performance required for systems that are presently being developed. JA2, which is a standard double base propellant used, for example, in the M829A1 and M829A2 tanks rounds, has an impetus value of 1150 Joules/gram or J/g. M43, which is used in the M900A1 cartridge, has an impetus of 1181 J/g. Both of these conventional propellants do not have the energy level to deliver the muzzle velocity required in future high energy tank systems such as the M829E3. Calculations have shown that an energy above the 1350 J/g threshold is needed.

In addition to the inability to generate adequate energy levels, present day propellants produce volatile organic compounds and ancillary waste, especially in enhanced demil and recyclability. To meet the environmental requirements of the Environmental Protection Agency to reduce the emission of solvents into the atmosphere, the propellant binder must be extruded under non-solvent processing methods.

It would be desirable if a binder system could be developed that would offer mechanical dampening coupled with high energy. This new system would be superior to conventional systems that use nitrocellulose and cellulose acetate butyrate, both in terms of superior mechanical properties but also with a LOVA style response to threat.

Accordingly, one object of the present invention is to provide a high energy propellant whose impetus is at or above the 1350 J/g level.

An additional object of this invention is to provide new energetic materials and processes that eliminate or greatly reduce both volatile organic compound production and ancillary waste through demil and recyclability. Other objects will appear hereinafter.

SUMMARY OF THE INVENTION

It has now been discovered that the above and other objects of the present invention may be accomplished in the following manner. Specifically, it has now been discovered that an improved high energy propellant may be prepared that has an impetus value of at least 1350 J/g. This family of propellants is expected to be of great value in new versions of the M829 cartridge as well as for other future tank systems yet to be developed.

The propellant comprises (1) at least one oxidizer, (2) a nitrocellulose binder, (3) an ethyl centralite stabilizer, (4) a plasticizer and (5) with and without an oxetane binder. If manufactured by a conventional solventless process, no oxetane binder is necessary.

The oxidizer is a high energy explosive filler comprises from about five percent to about forty percent by weight of the propellant. There are a number of preferred oxidizers. Most preferred are those selected from the group consisting of Hexanitrohexaazaisowurtzitane or CL-20, 1,3,3-Trinitroazetidine or TNAZ, nitramines, RDX or HMX. Mixtures thereof are also within the scope of this invention, so that two or more oxidizers may be used in accordance with this invention.

Nitrocellulose itself has been used as a binder, using solvents and plasticizers to colloid the nitrocellulose into a dough like consistency during mixing. The solvents are later removed from the propellant to form a solid propellant. In the present invention, however, it has been found that the use of an oxetane thermoplastic elastomer as described below permits the use of nitrocellulose without the use of solvents that later must be removed. Secondly, if a solventless process is utilized, only the plasticizer is needed to colloid the nitrocellulose. In the latter case, incorporation of oxetane will not be necessary. Therefore, the invention encompasses the two aforementioned cases. Sample 1 consisted of CL-20 or TNAZ, nitrocellulose binder, energetic plasticizer, stabilizer, and oxetane binder. Sample 2 consisted of CL-20 or TNAZ, nitrocellulose, plasticizer and stabilizer. Elimination of solvents such as ethyl alcohol, ethyl acetate, cellulose acetate butyrate and the like is a major advantage of the present invention. Nitrocellulose is used in an amount of about fifteen percent to about fifty percent by weight of the total propellant.

Also incorporated into the propellants of this invention is a quantity of ethyl centralite as a stabilizer. This stabilizer is added in an amount of about 0.7 percent to about 1.5 percent by weight of the total weight of the propellant.

The preferred propellant of this invention may also include an explosive plasticizer, preferably in an amount of about five percent to about thirty-five percent of the plasticizer by weight of the propellant. Examples of preferred plasticizers are 1,3,3-Trinitroazetidine or TNAZ; Diethylene glycol dinitrate or DEGDN, nitroglycerine or NG, Butanetrio-trinitrate or BTTN Trimethylolethane Trinitrate or TMETN; Triethylene Glycol Dinitrate or TEGDN; Bis, 2,2—Dinitro propyl acetal/Bis 2,2—Dinitro propyl formal or BDNPA/F; Methyl Nitrato ethyl nitramine or methyl NENA, ethyl NENA. These plasticizers may be used alone or in combination.

The oxetane thermoplastic elastomer can be melted at moderate elevated temperature and then solidified into an elastomeric material once it is cooled to a lower temperature such as ambient or lower. It is made from two types of monomers: 3,3-bis-azidomethyl-oxetane, or BAMO as a hard block, and 3-azidomethyl-3-methyloxetane, or AMMO as a soft block. The oxetane thermoplastic elastomer energetic binder is also known as AMMO/BAMO. It is included as a binder in an amount suitable for processing and formulating the desired- propellant. Preferred amounts range from about zero percent (if the solventless process is used) to about fifteen percent by weight, based on the total weight of the propellant.

DETAILED DESCRIPTION OF THE PREFERRED EMBODIMENT

The present invention has many advantages over the prior art propellant formulations. In its simplest form, the invention comprises at least one oxidizer, a nitrocellulose binder, an ethyl centralite stabilizer, a plasticizer and an oxetane binder.

The oxetane thermoplastic elastomer energetic binder is an essential part of the invention, and is available from Thiokol Corporation. It is capable of being melted at elevated temperatures to allot the binder to be processable with other propellant ingredients without the use of solvents, and this is a major advantage. In addition, as will be shown below, the oxetane thermoplastic elastomer energetic binder has excellent mechanical properties that are superior to conventional propellants because of elastomeric characteristics, especially at cold temperatures such as −20° to −40° F. This binder also has good mechanical properties that are important for uniform ballistic performance as well as having low vulnerability to shaped charge jet impact.

In order to verify the excellent properties of the oxetane thermoplastic elastomer energetic binder, thermal stability tests were performed. The binder was tested alone and with two preferred oxidizers. Results of these tests are shown in Table I below.

TABLE I

| Sample | Self Heat, °C. | Ignition, °C. |
|---|---|---|
| OXETANE Only | 166 | 229 |
| OXETANE/CL-20 (1:1) | 181 | 206 |
| OXETANE/TNAZ (1:1) | 153 | 216 |

In order to demonstrate the effectiveness of the propellants of this invention, a number of gun propellant formulations were mixed and extruded. Presented below in Table II are four formulations that have been prepared. All values for the composition are given in percent by weight, based on the total weight.

TABLE II

| Sample | oxidizer | nitro-cellulose | stabi-lizer | plasticizer | oxetane |
|---|---|---|---|---|---|
| A | CL-20/5% | 51% | 1% | BTTN/33% | 0 |
| B | TNAZ/15% | 51% | 1% | NG/DEGDN/33 | 0 |
| C | CL-20/*15% | 46% | 1% | BTTN/33% | 5% |
| D | RDX/20% | 47.5% | 1% | BTTN/31.5% | 0 |

*TNAZ was added as a second oxidizer.

Each of the above batches was formulated into a propellant by mixing and then extruding. The formulations were then tested for various properties to demonstrate the efficacy of the present invention. Specifically, impact, differential thermal analysis (DTA), and electrostatic and friction sensitivity characteristics. Presented below in Table IV are the results of these tests. The results show that impact sensitivities are similar to the conventional propellant M43, and that the products of this invention are quite thermally stable. A negative annotation for electrostatic sensitivity indicates no reaction to a 12 Joule electrostatic charge while a negative friction value is for a test with a 60 pound weight. The last two samples were not fully tested and n/a indicates that no data is available.

TABLE V

| Sample | Impact, (cm) | DTA, Self heat, (°C.) | DTA, Ignition, )°C.) |
|---|---|---|---|
| A | 36 | 186 | 200 |
| B | 31 | 185 | 205 |
| C | 29 | 185 | 205 |
| D | 40 | 180 | 204 |

The next evaluation of these samples was to determine the burn rate at various conditions. The data for the burn rates, presented below in Table VI, represent closed bomb data.

TABLE VI

| Sample | 20 kpsi | 30 kpsi | 35 kpsi | Exponent | Coefficient, ($\times 10^{-3}$) |
|---|---|---|---|---|---|
| A | 5.7 | 8.3 | 9.4 | 0.96 | 0.7213 |
| B | 5.5 | 8.4 | 9.4 | 0.97 | 0.376 |
| C | 5.5 | 9.1 | n/a | 1.02 | 0.220 |

The data shows that high energy gun propellants at an energy level of 1350 J/g can be formulated. Desirable burning rates and other properties can be obtained from these formulations that eliminate or greatly reduce both volatile organic compound production and ancillary waste through demil and recyclability.

While particular embodiments of the present invention have been illustrated and described herein, it is not intended that these illustrations and descriptions limit the invention. Changes and modifications may be made herein without departing from the scope and spirit of the following claims.

We claim:

1. A high energy gun propant having an impetus of at least about 1350 Joules/gram adapted for use in tank ammunition and providing said ammunition with a LOVA style response to threat, said propellant having improved mechanical properties and a composition consisting essentially of (a) about 51% by wt. nitrocellulose, (b) about 1% by wt. ethyl centralite, (c) about 15% by wt. trintrioazetidine, and (d) about 33% by weight of a mixture of nitroglycerin and diethylene glycol dinitrate.

2. The propellant of claim 1 having a self-heat temperature of about 185 degrees C. and an ignition temperature of about 205 degrees C.

3. The propellant of claim 2 wherein the burn rate exponent is about 0.97.

* * * * *